United States Patent [19]

Ehrlich

[11] Patent Number: 4,550,696

[45] Date of Patent: Nov. 5, 1985

[54] INTERNAL COMBUSTION ENGINE WITH DISC INLET VALVE

[75] Inventor: Josef Ehrlich, Berkhamsted, England

[73] Assignee: Outboard Marine Corporation, Waukegan, Ill.

[21] Appl. No.: 642,177

[22] Filed: Aug. 20, 1984

[30] Foreign Application Priority Data

Aug. 26, 1983 [GB] United Kingdom ..... 8323081

[51] Int. Cl.[4] ..... F01L 7/06

[52] U.S. Cl. ..... 123/73 D; 123/80 D; 123/190 D

[58] Field of Search ..... 123/51 B, 51 BD, 65 V, 123/65 VS, 73 R, 73 A, 73 C, 73 CA, 73 D, 73 V, 190 D, 80 D

[56] References Cited

U.S. PATENT DOCUMENTS

| | | | |
|---|---|---|---|
| 1,130,427 | 3/1915 | O'Neal | 123/190 D |
| 1,227,698 | 5/1917 | Tibbetts | 123/190 D |
| 2,682,260 | 1/1953 | Lantz | 123/90.17 |
| 3,119,380 | 1/1964 | Armstrong | 123/73 D |
| 3,392,713 | 7/1968 | Hilber et al. | 123/73 D |
| 3,603,299 | 9/1971 | Lamperti | 123/190 D |
| 4,071,000 | 1/1978 | Herbert | 123/73 D |
| 4,079,706 | 3/1978 | Konig | 123/73 D |
| 4,305,352 | 12/1981 | Oshima et al. | 123/90.15 |
| 4,418,658 | 12/1983 | DiRoss | 123/190 D |

FOREIGN PATENT DOCUMENTS

| | | | |
|---|---|---|---|
| 1094040 | 12/1960 | Fed. Rep. of Germany . | |
| 1576238 | 3/1970 | Fed. Rep. of Germany . | |
| 2630512 | 1/1978 | Fed. Rep. of Germany . | |
| 2814344 | 10/1979 | Fed. Rep. of Germany . | |
| 3243682 | 8/1983 | Fed. Rep. of Germany . | |
| 268279 | 8/1950 | Switzerland . | |
| 190238 | 12/1922 | United Kingdom . | |
| 218197 | 7/1924 | United Kingdom . | |
| 673994 | 6/1952 | United Kingdom . | |
| 703916 | 2/1954 | United Kingdom . | |
| 886471 | 1/1962 | United Kingdom . | |
| 892066 | 3/1962 | United Kingdom | 123/73 D |
| 2111591 | 7/1983 | United Kingdom . | |
| 2145471 | 3/1985 | United Kingdom . | |

*Primary Examiner*—Craig R. Feinberg
*Assistant Examiner*—David A. Okonsky
*Attorney, Agent, or Firm*—Michael, Best & Friedrich

[57] ABSTRACT

A high performance two-stroke internal combustion engine comprises at least one disc inlet valve driven from a shaft via bevel gears. The shaft is driven from a pinion secured to the engine crank-shaft via a variable drive. The variable drive includes a spring which biases a cross pin to one end of a spiral slot in the shaft to maintain pinion at a position relative to the shaft which provides maximum inlet valve advance during starting. As engine revs increase the pinion progressively leads the shaft thereby retarding inlet valve timing. When the valve timing is fully retarded a bobbin of the drive is latched by a magnet to hold the valve timing fully retarded until engine revs fall.

4 Claims, 4 Drawing Figures

INTERNAL COMBUSTION ENGINE WITH DISC INLET VALVE

This invention relates to internal combustion engines, and more particularly to an internal combustion engine having a disc inlet valve.

It is known in high performance two-stroke engines to provide an inlet valve comprising two fixed members defining a narrow gap therebetween and provided with aligned ports, and a disc mounted for rotation in the gap and having a cut-away portion which registers with the ports each revolution of the disc to open the valve to inlet mixture flow. In such known valves, commonly called "disc valves", the disc is rotationally fast with the crank-shaft, e.g. by way of a splined hub keyed to the crank shaft which engages a splined aperture at the centre of the disc. With such an arrangement the timing of the inlet valve opening and closing is fixed, and is determined by the angular position of the disc relative to the crank-shaft. The desirable features of easy starting, high torque at low speed, and high power at high speed tend to dictate different ideal inlet valve timing arrangements. For this reason, in prior art engines the selection of inlet valve timing has been a compromise.

According to one aspect of the present invention an internal combustion engine having a disc inlet valve is provided with means for varying the timing of inlet valve opening and/or closing.

Variation in timing may be achieved by altering the angular position, relative to the axis of disc rotation, of the leading and/or trailing edge of the inlet port thereby varying the position on the crank-shaft rotation cycle at which the inlet valve opens and/or closes, or by varying the phase relation of the disc relative to the crank-shaft.

In a particularly preferred arrangement the disc is driven from the crank shaft via a drive train which permits limited angular movement of the disc relative to the crank-shaft and means are provided for controlling the angular position of the disc relative to the crank-shaft in dependence upon engine operating characteristics.

In the preferred embodiment of the invention the disc is maintained at one extreme of its angular movement relative to the crank-shaft when the engine is stationary, and during starting. This angular position provides the maximum advance of inlet valve timing, and thus provides more easy starting. As engine speed increases the disc moves progressively towards the other extreme angular position, thereby progressively retarding the inlet valve opening. Means are preferably provided such that, once the disc has attained the fully retarded position, it is maintained in that position until some predetermined change in engine operating characteristics e.g. a reduction in engine speed, occurs.

In an alternative arrangement one or more masking members are provided for variably masking the leading and/or trailing edges of the inlet port. Thus, when the engine is stationary the masking members adopt a position providing optimum inlet valve setting for starting, and the masking members are controlled in accordance with engine operating characteristics to vary the angular position of the leading and trailing edges of the inlet port to provide optimum performance at both low and high engine speeds.

The above and further features and advantages of the invention, together with various modifications thereof, will become clear from the following description of a preferred embodiment thereof, given by way of example only, reference being had to the accompanying drawing wherein.

Figure 1:
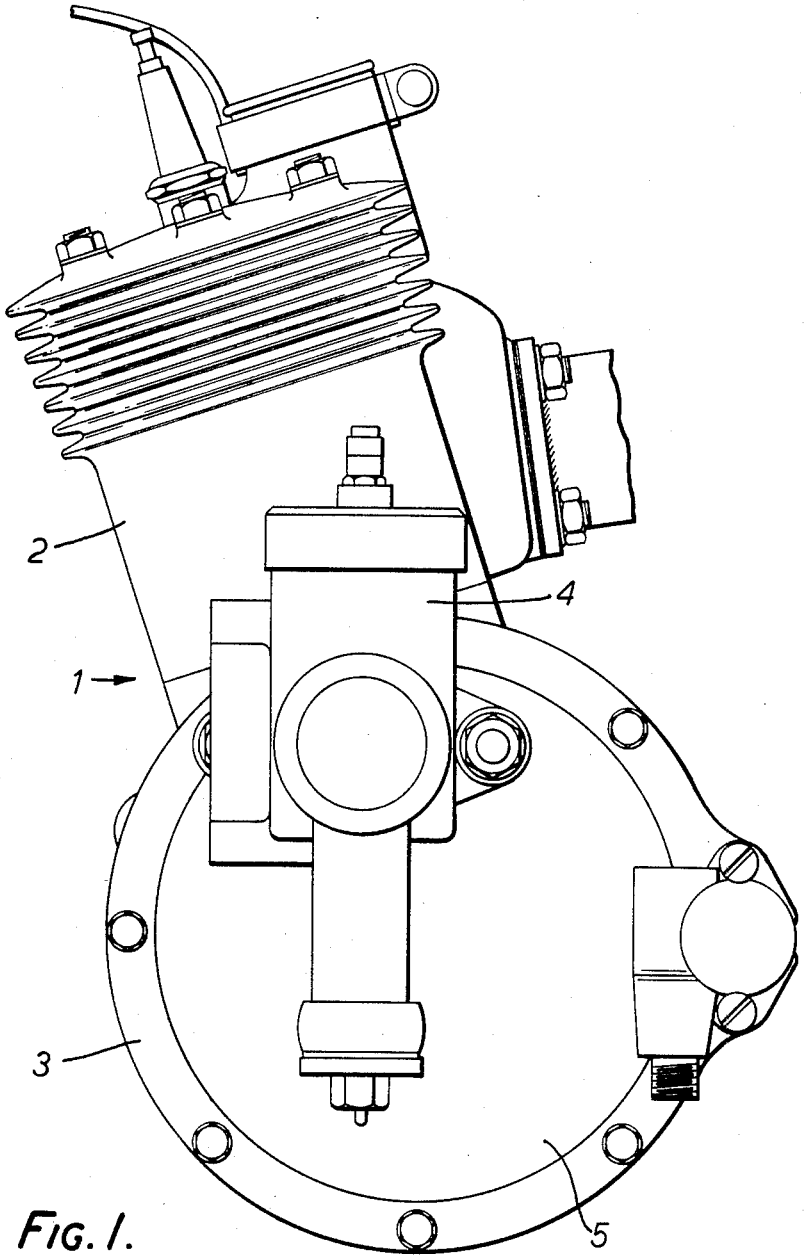
FIG. 1 is an end view of a prior art engine having a disc inlet valve.

Referring firstly to FIG. 1, a two stroke engine 1 comprising a cylinder 2 and crank-case 3 is shown. A carburettor 4 is secured to the crank-case 3 such that the throat of the carburettor is aligned with a port provided in the crank-case end cover 5. Communication between the end cover port and the interior of the crank-case is controlled by a disc (not visible in the drawing) which is keyed to the engine crank-shaft for rotation therewith. The disc is located in a narrow gap between the end cover 5 and a substantially co-extensive backing member which includes a port aligned with the end cover port. The disc has a cut-away part which periodically registers with the ports to provide communication between the carburettor and the crank-case interior for the flow of fuel/air mixture. During the part of each cycle that the cut-away portion is not in register with the ports the disc substantially seals the ports.

In prior art engines of this type the disc is rotationally fast with the crank-shaft, and the inlet valve timing is fixed, leading to the disadvantages outlined above.

Figure 2:
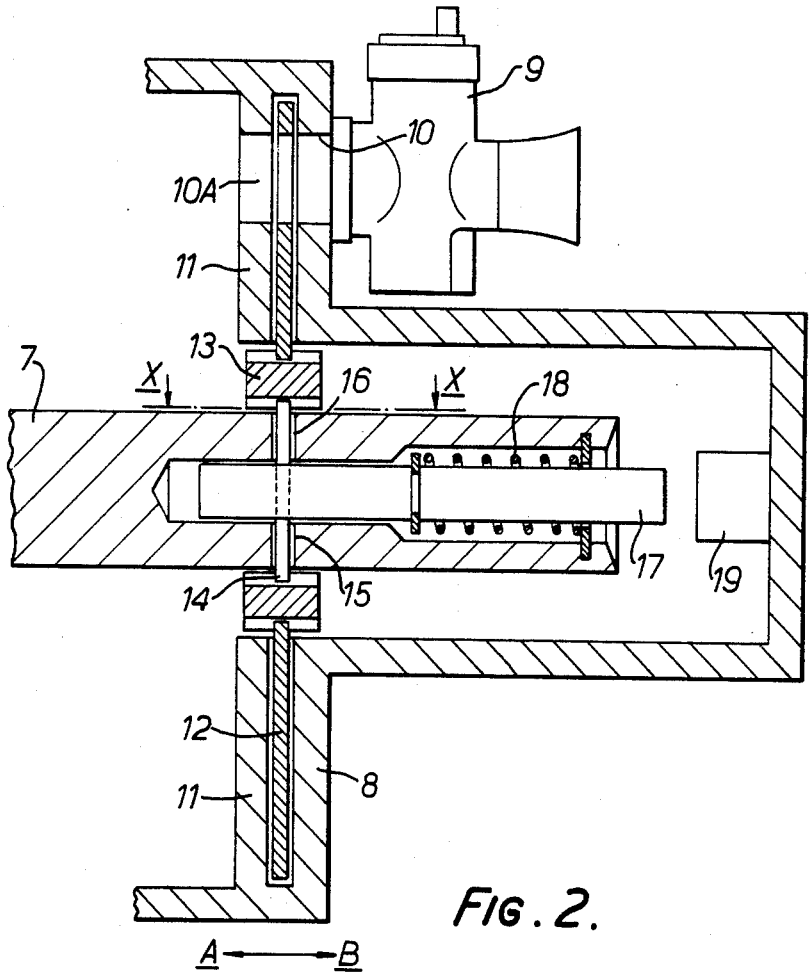
FIG. 2 illustrates schematically a disc valve arrangement for use in an embodiment of the present invention.
Figure 3:
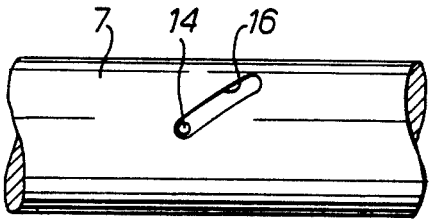
FIG. 3 is a view on the line X—X of FIG. 2.

Referring now to FIGS. 2 and 3 there is shown schematically in section the end region of a two-stroke engine in accordance with the invention. The engine has a crank-shaft 7 supported in bearings mounted in a crank-case having an end cover 8. A carburettor 9 is mounted on the end cover 8 in communication with a port 10 in the end cover 8. A backing member 11 is secured to the crank-case and defines with the end cover 8 a narrow gap in which is located a valve disc 12. The disc 12 includes a cut-away portion which when in register with the port 10 and a corresponding port 10A in the plate 11 defines the "valve open" state. When a solid portion of the disc 12 is in register with the ports a "valve closed" state is defined.

The disc 12 is mounted by way of interengaging splines on a hub 13 whereby the disc 12 rotates with the hub 13, but is free to move axially relative to the hub 13. In prior art designs the hub 13 has been keyed to the crank-shaft 7, and accordingly the valve timing is fixed once the disc 12 has been mounted.

In this embodiment of the present invention the hub 13 is rotatable to a limited extent relative to the crank-shaft 7, and accordingly the timing of the inlet valve opening is variable within certain limits. To this end, instead of being keyed to the crank-shaft 7, the hub 13 is engaged by the opposite ends of a pin 14 which passes diametrically through the crank-shaft 7. The pin 14 is a clearance fit in a pair of spiral grooves 15,16 formed in the crank-shaft. Thus, as the pin 14 moves axially of the crank-shaft (in the direction of arrow A-B) it is constrained to rotate about the crank-shaft axis of rotation. Since the ends of the pin 14 are received in close-fitting grooves in the hub 13, axial movement of the pin 14 causes rotation of the hub 13 relative to the crank-shaft within limits determined by the extent of the spiral grooves 15, 16.

Longitudinal movement of the pin 14 is controlled by a spindle 17 having a cross-bore in which the pin 14 is snuggly received. The spindle 17 is biased to the left (as viewed in the drawing) relative to the crank-shaft by a spring 18 whereby the pin 14 normally adopts a position located at one extreme end of the grooves 15,16. In this position of the spindle 17, pin 14, hub 13, and disc 12 the opening (and closing) of the inlet valve is in the most advanced position possible, thereby providing for easy starting of the engine. The various components are retained in the starting configuration until the engine speed rises to such a level that the inertial and frictional forces acting on the disc 12 and hub 13 are sufficient to overcome the bias of the spring 18, whereupon the pin 14 will begin to move towards the other end of the spiral grooves 15,16 thereby causing the spindle 17 to move to the right as viewed in the drawing, and causing the disc 12 to rotate relative to the crank-shaft 7. Such movement causes progressive retardation of the opening and closing of the inlet valve.

Eventually, the pin 14 will reach the other extreme end of the spiral grooves 15,16 thereby providing maximum retardation for the inlet valve opening and closing. At this point, axial movement of the spindle 17 will be sufficient to bring the spindle into engagement with a magnet 19 fixed to the engine crank-case. Magnetic attraction between the magnet 19 and the spindle 17 (which should, of course, be of ferrous material) will then hold the spindle 17 against the magnet 19 and maintain the disc 12 in the fully retarded position. This state of affairs will continue until there is a decrease in engine speed, whereupon the inertial force caused by the disc 12 and hub 13 tending to rotate faster than the crank-shaft will act via the pin 14 and spiral grooves 15,16 to cam the spindle 17 away from the magnet 19. As soon as the spindle 17 clears the magnet 19 the spring 18 will act to return the disc, etc. to their starting positions.

Whilst the above represents a particularly advantageous embodiment of the invention it will be appreciated that many modifications and alternative arrangements are possible. For example, the magnet 19 may be a permanent magnet, or may be an electro-magnet which can be selectively de-energized to release the spindle. Other mechanical, electrical, or electronic latching arrangements may be used to retain the spindle 17 as described above. The release of the spindle may be controlled, when using such devices, by engine speed, changes in engine speed, exhaust pressure, or any other desired characteristics.

Further the axial position of the spindle 17, and thus the angular position of the disc 12 relative to the crank-shaft may be directly controlled by use of any suitable actuator for locating the spindle in a desired position.

In a further embodiment of the invention, not shown, masking members are provided at the leading and/or trailing edges of the inlet port defined in either the inner or the outer plate. The position of the masking members may be controlled by any suitable means to define the angular position of the leading and trailing edges of the inlet port. This arrangement may be used in association with a disc 12 angularly fixed relative to the crank-shaft 7, or may be used in association with the disc arrangement outline above.

The invention may, if desired, be used in association with a power controlled exhaust valve arrangement, in which case the control of the exhaust valve may be independent of the control of the inlet valve, or the control of inlet and exhaust valves may be co-ordinated to provide optimum performance under all operating conditions. Inlet valve timing may be controlled in response to exhaust pressure whether or not a similarly controlled exhaust valve is used.

It will be appreciated from the above description that the use of a disc movable to a limited angular extent relative to the crank-shaft enables the timing of the opening and closing of the inlet valve to be controlled. The use of masking members also enables inlet valve timing to be controlled, and further has the advantage of enabling the period (in terms of degrees of crank-shaft rotation) of inlet valve opening to be controlled.

Figure 4:
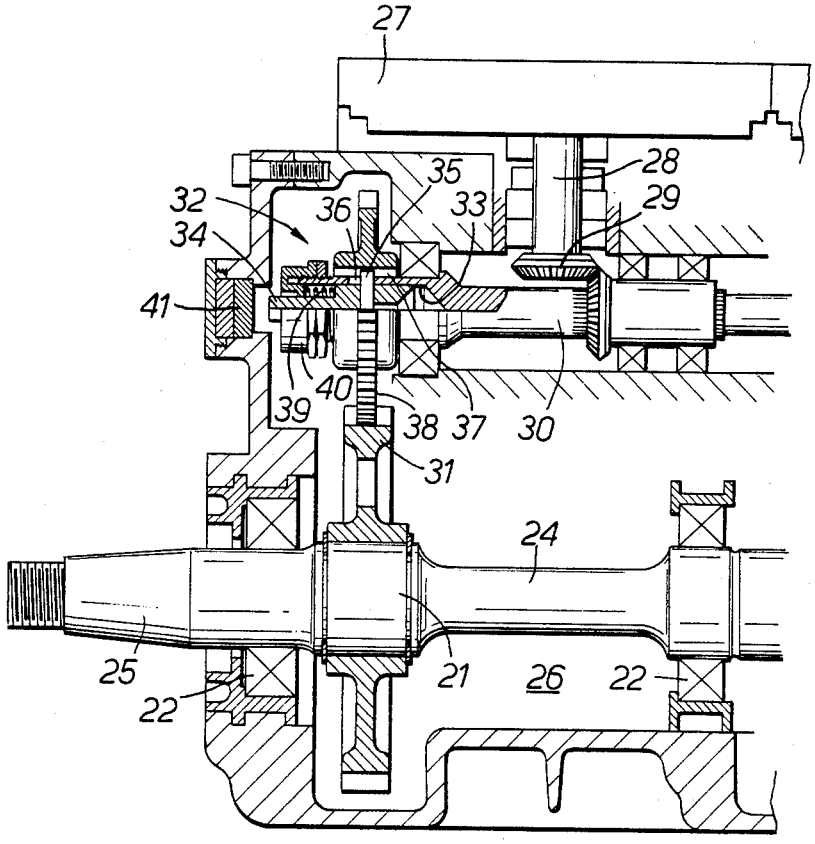
FIG. 4 shows, partly in section, part of a practical embodiment of the present invention.

Referring now to FIG. 4 there is shown in partial cross-section part of a multi-cylinder two-stroke engine. Only the region of the engine associated with one cylinder is shown, it being understood that each additional cylinder is associated with similar components to those illustrated and is located to the right (as viewed in the drawing) of the region illustrated.

The engine 20 shown in FIG. 4 has a crank-shaft 21 supported in bearings mounted in a crank-case 23 in conventional manner. The connecting rod has been omitted from the drawing in the interests of clarity but would, in use, engage the crank 24. The crank-shaft 21 terminates in a tapered end portion 25 for receipt of a drive pulley or the like. The zone of the crank-case associated with each cylinder (the zone 26 in the case of the region illustrated) is provided with a respective disc inlet valve 27 of the general type described above, i.e. a rotating disc mounted between two closely spaced ported members and rotatable to move a cut-away portion of the disc into and out of register with the ports. The disc of the valve is rotationally fast with a shaft 28 which is driven via a bevel gear 29 by a shaft 30 which is parallel to the axis of rotation of the crank-shaft 21. The shaft 30 is common to all the disc valves of the engine and accordingly all the disc valves are rotated synchronously by rotation of the shaft 30. The shaft 30 may also drive other items of equipment if desired.

The shaft 30 is driven via a variable drive mechanism 32 from a pinion 31 secured to the crank-shaft 21. The variable drive mechanism 32 provides for controlled relative rotational movement of the shaft 30 relative to the crank-shaft 21 and thus provides the desired variation in the phasing of the disc positions relative to the crank-shaft which gives the appropriate change in inlet valve timing.

The variable drive mechanism 32 comprises a bore 33 in the end of shaft 30 in which is slidingly received a steel bobbin 34. The bobbin 34 has a cross-bore which receives as a close sliding fit a pin 35. The pin 35 projects through a pair of helical slots 36 (only one of which is shown) in the shaft 30 and is received at each end in a respective groove 37 formed in a pinion 38 which is in mesh with pinion 31. A compression spring 39 is located between the bobbin 34 and a nut 40 secured to the end of shaft 30. The spring 39 biases the bobbin to the right as viewed in the drawing, thereby retaining the pin 35 in the position illustrated when the engine is not running. This position of the pin 35 puts the pinion 38 in such a position relative to the shaft 30 as to provide maximum inlet valve advance.

In use, as engine speed increases, the pinion 38 will move relative to the shaft 30 in a manner analogous to the movement of the disc 12 relative to the shaft 7 as described above with reference to FIG. 2, thereby progressively retarding the inlet valve timing. Movement of the pinion 38 relative to the shaft 30 will cause the pin 35 to move along the slots 36, moving the bobbin 34 to the left and compressing the spring 39 in the process. When the pin 35 reaches the limit of available travel within the slots 36, the bobbin engages and latches to a permanent magnet 41 mounted on the crank-case. The magnet 41 operates as described above with reference to the magnet 19 of FIG. 2 to maintain the valve timing in its fully retarded condition until the latching effect is overcome by a decrease in engine speed or some other control factor.

It will be appreciated that the various modifications referred to above with reference to FIG. 2 may be applied to the arrangement of FIG. 4.

Whilst the invention has been described with particular reference to the inlet valve of a two-stroke engine it will be appreciated that it may be generally applicable to other rotating valve arrangements, e.g. rotating exhaust valves or rotating inlet valves of four-stroke engines.

I claim:

1. An internal combustion engine having a rotary disc inlet valve, means for varying timing of opening and closing of said inlet valve to a fully retarded condition in response to an increase in engine speed, and latch means for holding said inlet valve in the fully retarded condition and including a magnet which latches a part of the means for varying the timing of said inlet valve in a position corresponding to the fully retarded condition of said inlet valve.

2. An internal combustion engine having an inlet valve including a rotary disc, and means for varying timing of opening and closing of said inlet valve, said means for varying the timing of said inlet valve comprising a drive shaft having therein a spiral slot, a cross pin carried by said drive shaft and located in said spiral slot, whereby rotation of said pin relative to said shaft is accompanied by axial movement of said pin relative to said shaft, said cross pin being rotationally fixed to said rotary disc, and means for biasing said cross pin axially of said shaft so that, in the absence of rotation of said shaft, said cross pin is located at one end of said spiral slot and said disc is located at one angular position relative to said shaft, and so that, upon acceleration of the engine, said pin moves axially of said shaft to rotate said disc relative to said shaft due to rotation thereof.

3. An internal combustion engine according to claim 2 wherein the engine includes a crank-shaft, a plurality of said inlet valves, and a single element is provided to vary simultaneously the phase relationship between all of said inlet valves and said crank-shaft.

4. An internal combustion engine according to claim 3 wherein the engine includes a common shaft driving said discs and said element forms a driving connection between said common shaft and said crank-shaft.

* * * * *